US005335989A

United States Patent [19]

Tanaka

[11] Patent Number: 5,335,989

[45] Date of Patent: Aug. 9, 1994

[54] ASPHALT RECYCLING APPARATUS

[75] Inventor: Shigehiro Tanaka, Kyoto, Japan

[73] Assignee: Tanaka Giken Co., Ltd., Kyoto, Japan

[21] Appl. No.: 925,876

[22] Filed: Aug. 7, 1992

[30] Foreign Application Priority Data

Aug. 30, 1991 [KR] Rep. of Korea ..... 1991-15123

[51] Int. Cl.[5] ..... B28C 5/46

[52] U.S. Cl. ..... 366/25; 366/47

[58] Field of Search ..... 366/2, 4, 7, 25, 24, 366/45, 47, 48, 144, 147

[56] References Cited

U.S. PATENT DOCUMENTS 3,992,899 11/1976 Spahn ..... 366/147
4,219,278 8/1980 Mendenhall ..... 366/25
4,240,754 12/1980 Mendenhall ..... 366/25

FOREIGN PATENT DOCUMENTS 53-110957 9/1978 Japan .
54-119525 9/1979 Japan .
57-193704 12/1982 Japan .
58-33605 2/1983 Japan .

*Primary Examiner*—Robert W. Jenkins
*Attorney, Agent, or Firm*—Cushman, Darby & Cushman

[57] ABSTRACT

An asphalt recycling apparatus includes a combustion drum which is rotatably mounted in an enclosure; the outer surface of the drum is covered with an insulating material and the enclosure includes a storage member for a gas fueled burner for treating waste asphalt pieces in the combustion drum; the enclosure is provided with a pair of doors disposed on the front side of the casing and the combustion drum is mounted for tilting movement substantially about a horizontal axis; the pair of doors are provided with a support for the combustion burner so as to direct the flame of the burner to an opening in the combustion drum; a chute door is disposed below the front opening of the casing and hinged to the casing.

5 Claims, 4 Drawing Sheets

ASPHALT RECYCLING APPARATUS

BACKGROUND OF THE INVENTION (a) Technical Field of the Invention

This invention relates to a small-sized asphalt recycling apparatus which can be carried on a vehicle such as a truck, and is adapted to be used for recycling on site asphalt pieces ripped off from a paved road.

(b) Description of the Prior Art

In the construction site for repairing underground piping and wiring such as gas pipe, water supply and drainage, electric and telephone cables buried under a paved road, a dug-out area, if it is of a small size, of the road is conventionally provisionally restored by filling the digged-out area with a cold mixture which can be cured under the normal temperature.

However, this conventional cold mixture is generally accompanied with problems in terms of physical strength and adhesion strength, so that this repaired area of the road is easily destroyed by the passing of vehicles. For example, the filled materials are scattered out as pieces, or the repaired area is gradually depressed. When these defects have have occured after the repair of the road, it is again required to remove the filled materials from the repaired area and to newly fill the repaired area with a hot mixture.

Accordingly, it is preferable to repair the dug-out area of the road by using a hot mixture first of all instead of using a cold mixture. However, the hot mixture is generally manufactured in an asphalt recycling plant of large scale, so that it is rather difficult to convey a small amount of the hot mixture every time such a repairing work of small scale is required.

A vehicle mounted thereon with an asphalt-recycling plant is also known. Even with such a special vehicle, it is still difficult to avoid the wasting of the hot mixture in the repairing work of small scale as mentioned above.

It may be conceivable to employ a small combustion drum. However, if such a combustion drum is simply mounted on a vehicle, an operator may face a risk of accidentally touching a hot outer surface of the heated combustion drum, and, at the same time, since the combustion drum itself is exposed to outer atmosphere, it is undesirable in terms of the heating efficiency of the combustion drum.

SUMMARY OF THE INVENTION

This invention has been made in view of above problems, and has its object to provide an asphalt-recycling apparatus of small size, so that the apparatus can be carried on a vehicle such as a truck together with other instruments for repairing the underground piping or wiring.

According to this invention, there is provided an asphalt recycling apparatus which comprises:

- a combustion drum having an open top and rotatably supported on a supporting frame mounted in a casing;
- a driving means for rotating the combustion drum around the axis thereof;
- a manipulating handle for tilting the open top of the combustion drum;
- a front opening portion provided at a portion of the casing which faces to the open top of the combustion drum;

- a pair of front doors for opening or closing the front opening portion;
- a supporting rod means, one end of which is connected to the back surface of one of the front doors, and the other end of which is detachably connected to the back surface of the other one of the front doors;
- a burner-supporting means mounted on the supporting rod means so as to direct a burner toward the open top of the combustion drum; and
- a chute door disposed below the front door so as to be pivotally moved up and down, and adapted to guide a regenerated asphalt discharged from the combustion drum tilted downwardly.

Since the interior of the combustion drum is thermally insulated by the heat-insulating cover, not only an efficient heating of waste asphalt pieces can be realized, but also safety in operation will be assured, because the heat within the combustion drum will be effectively prevented from being transmitted outward due to the presence of the insulating cover as assisted by the use of casing.

BRIEF DESCRIPTION OF THE DRAWINGS

This invention will be further explained with reference to the accompanying drawings, wherein.

DESCRIPTION OF THE PREFERRED EMBODIMENTS

In the following, this invention will be explained about a preferred embodiment wherein an asphalt-recycling apparatus of this invention is mounted on a truck.

Figure 1:
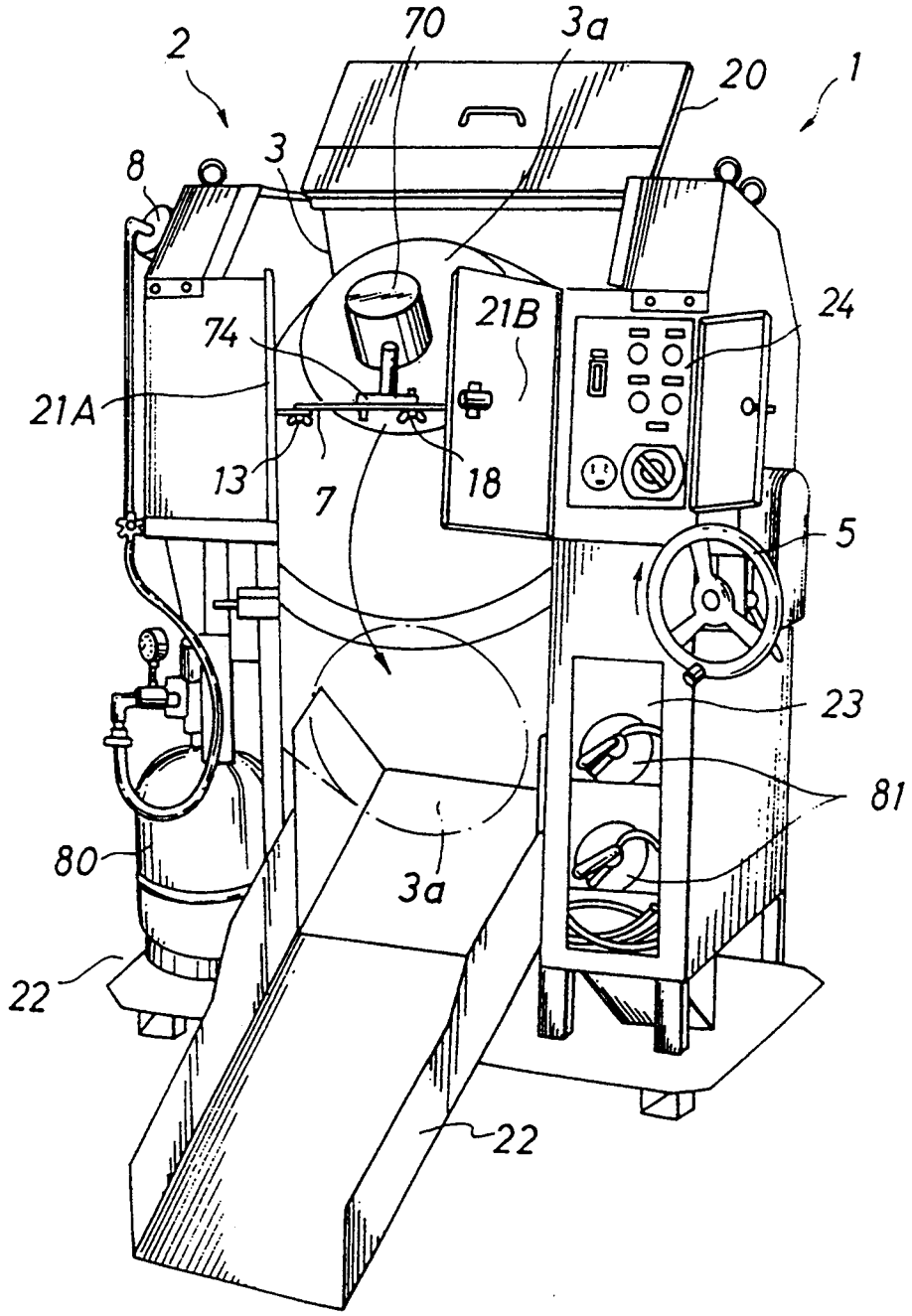
FIG. 1 is a perspective view showing a preferred embodiment of an asphalt recycling apparatus according to this invention.
Figure 2:
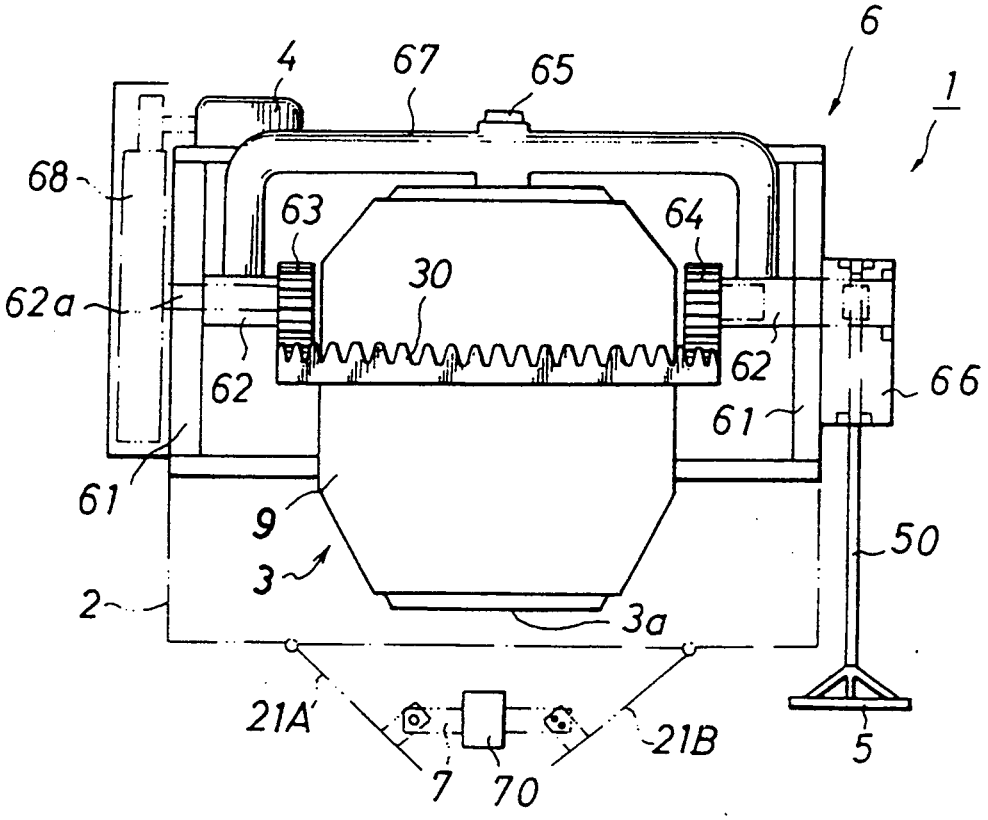
FIG. 2 is a plan view of the apparatus shown in FIG. 1.
Figure 3:
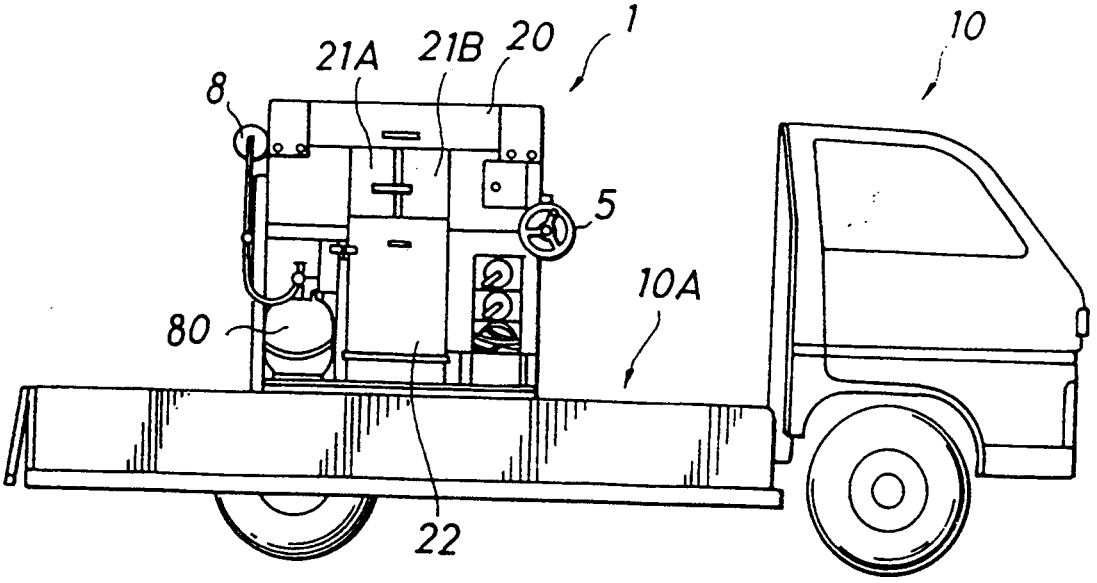
FIG. 3 is a side view of the aspahlt-recycling apparatus mounted on the loading platform of a truck.

Referring to FIG. 1 to FIG. 3, the asphalt-recycling apparatus 1 comprises a casing 2 mounted on the truck 10, a combustion drum 3 supported on a supporting frame 6 and housed in the casing 2, and a burner 8 attached to a burner-supporting member 70 which is mounted on a pair of front doors 21A, 21B of the casing 2 in such a manner that the flame of the burner 8 can be projected into the combustion drum 3.

The casing 2 in this embodiment is of a box type whose top and front sides are designed to be opened and covered on its inner wall with linings consisting of a heat-insulating material and a sound-insulating material (For example, glass wool). On the open top of the casing 2 is attached a top door 20 which is foldable in half. On the opening located at the upper portion of the front side of the casing 2 is attached a pair of front doors 21A, 21B of a double door type, one side of each door 21A, 21B being hinged to the opening so as to open or close at the center. On the opening located at the lower portion of the front side of the casing 2 is attached a shoot door 22 whose lower end is pivotally attached to a rod member which is horizontally disposed at a lower portion of the casing 2, so that the upper portion of the shoot door 22 can be allowed to move downward thereby to open the shoot door 22 so as to act as a shoot.

The combustion drum 3 housed in the casing 2 is of a pot-like shape in this embodiment, and has on its top an opening 3*a* communicating with the hollow interior thereof. This combustion drum 3 is sustained in the casing 2 by means of a frame 6 in such a manner as to keep the opening 3*a* slanted upwardly. The portion near the opening 3*a* of this combustion drum 3 is covered with a heat-insulating material, and the trunk portion of this combustion drum is integrally provided with a crown wheel (gear) 30 of circular shape (FIG. 2).

Figure 6:
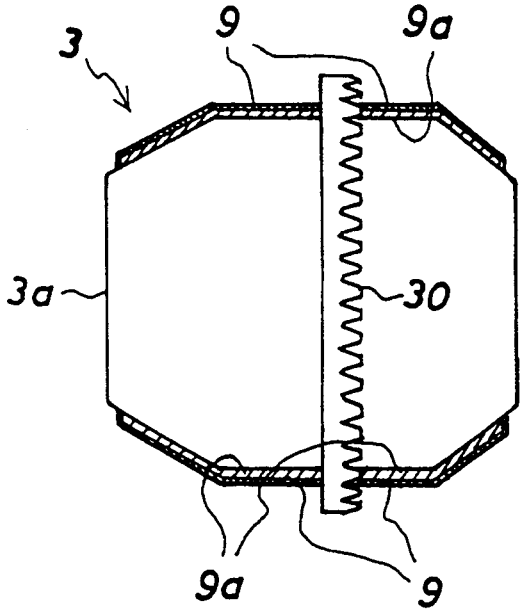
FIG. 6 is a sectional view of the heat-insulating cover mounted on the combustion drum.

As clearly shown in FIG. 6, a heat-insulating cover 9 is mounted to surround the whole outer circumferential wall of the combution drum except the portion thereof to which the gear 30 is attached.

This heat-insulating cover 9 is made of steel sheet and formed into cylindrical shape which is similar to, but larger than the outer circumferencial shape of the combustion drum 3. The both end portions of heat-insulating cover 9 are fixed to the combustion drum 3 by means of fusion.

A space is formed between the heat-insulating cover 9 and the combustion drum 3, and is filled therein with a heat-insulating material 9*a* such as glass wool or asbestos so as to cover the outer circumferential wall of the combustion drum 3.

It is noted that, in this embodiment shown in the drawings, the heat-insulating cover 9 is not disposed at the bottom of the combustion drum 3. This is because the bottom portion of the combustion drum 3 is generally covered by asphalt, and the heating flame hardly reaches directly to the bottom portion of the combustion drum 3. Moreover, the intense heat within the combustion drum 3 is conducted along the inner circumferential wall of the combustion drum 3, and therefore the bottom portion of the combustion drum 3 is hardly heated to a high temperature as compared with the circumferential wall of the combustion drum 3. In view of this phenomenon, the provision of the heat-insulating cover 9 at the bottom portion of the combustion drum 3 is omitted in view of cost saving.

However, it is also possible to cover the heat-insulating cover 9 all over the outer wall of the combustion drum 3 including the bottom portion thereof.

The supporting frame 6 comprises a pair of U-shaped leg members 61 disposed on left and right sides of the combustion drum 3, a pair of bearing shafts 62 rotatably received in the upper portion of the leg members 61 and extending to the opposite sides of the combustion drum 3, a main driving gear 63 fixed to the tip portion of a rotating shaft 62*a* passing through one of the shafts 62 and engaging with the crown wheel 30 of the combustion drum 3, a driven gear 64 idly fitted in the tip portion of the other one of the shafts 62 and engaging with the crown wheel 30 of the combustion drum 3, and a rotating shaft 65 rotatably connected at the central bottom portion of the combustion drum 3 to the center portion of a connecting rod 67 which is extended from both of the shafts 62 and curved along the bottom portion of the combustion drum 3.

The proximate end of the rotating shaft 62*a* of the main driving gear 63 is connected to the rotating shaft of the driving means 4 consisting of an electric motor through a decelerating gear apparatus 68.

Accordingly, when the electric motor 4 is actuated, the rotating power is transmitted to the main driving gear 63 through the decelerating gear apparatus 68 and rotating shaft 62*a*, and the combustion drum 3 is caused by way of the engaging action of the crown wheel 30 to be rotated around the axis of the rotating shaft 65. In this case, the driven gear 64 supports the combustion drum 3 while being rotated through the engagement thereof with the crown wheel 30.

The shaft 62 located on the driven gear 64 is rotatably received in a box 66 disposed adjacent thereto, and engaged within the box 66 with a handle shaft 50 extended in perpendicular to a worm of a worm wheel of the shaft 62.

Since both of the shafts 62 are connected with each other through the connecting rod 67, and rotatably received at the upper portion of the leg members 61, the combustion drum 3 can be tilted through the manipulation of the handle 5 fixed at the tip portion of the handle shaft 50, thereby moving the opening 3*a* of the combustion drum 3 downward or upward.

Figure 5:
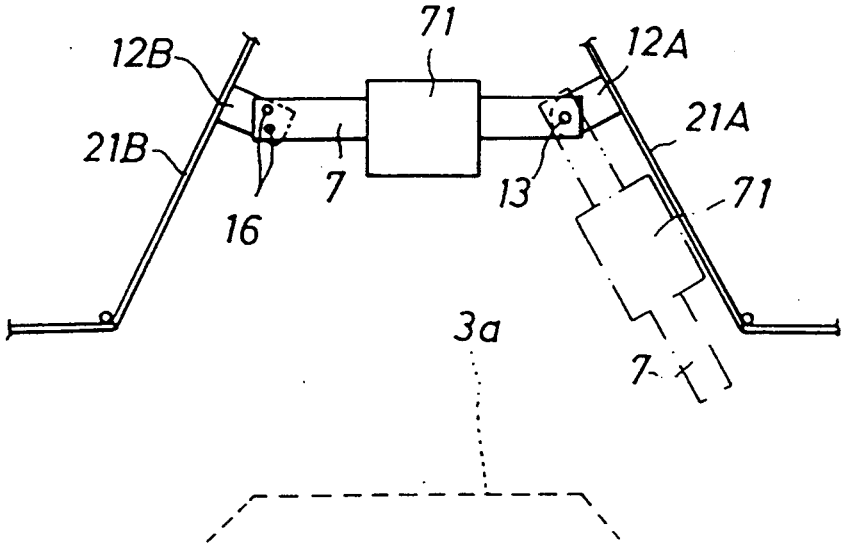
FIG. 5 is a back side view of the portion of the apparatus shown in FIG. 4.

On the pair of front doors 21A, 21B are mounted a cross member 7 having a burner-supporting member 70. Specifically, one end of the supporting rod 7 is rotatably hinged by means of a bolt 13 and a nut 14 to a first bracket 12A projecting from the back side of the front door 21A. The other end of the cross member 7 (free end) is provided with a pair of through-holes 15 as shown in FIG. 5.

On the back side of the other front door 21B is projected a second bracket 12B on which a pair of pins 16 are projected in conformity with the through-holes 15 to be engaged therewith.

Figure 4:
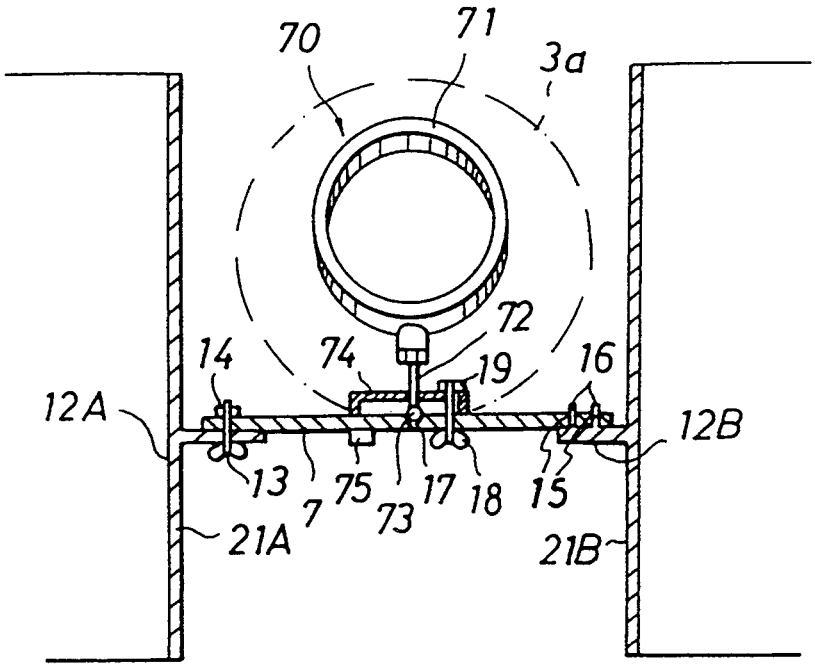
FIG. 4 is a plan view of a portion of the apparatus including a supporting rod means and a burner-supporting means.

Accordingly, when the front doors 21A, 21B are half opened so as to form a taper-like shape as shown in FIG. 4, the other end (free end) of the cross member 7 can be fixed to the other one of the doors by fitting the through-holes 15 in the pins 16 after loosening the bolt 13 and nut 14 attached to the one end of the cross member 7. Thereafter, the bolt 13 and the nut 14 are tightened to firmly fix the cross member 7 to a predetermined position. When the cross member 7 is not in use, the nut 14 is loosened and the through-holes 15 are detached from the pins 16. Thereafter, the cross member 7 is rotated together with the burner supporting member 70 until it takes a folding position i.e. it becomes parallel with the back side of the one of the front doors 21A, and finally the bolt 13 and nut 14 are fastened. In this manner, the cross member 7 can be folded behind the front door 21A, when the apparatus is not in use.

The burner supporting member 70 is mounted on this cross member 7. This burner supporting member 70 comprises a forwardly tilted cylindrical member 71, a leg portion 72 supporting the cylindrical member 71, and a stand portion 74 disposed in perpendicular to the leg portion 72. The stand portion 74 is fixed to the supporting rod 7 by means of the nut 19 and bolt 18.

And said leg portion 72 is penetrated into the stand portion 74.

The lower end portion of the leg portion 72 is shaped into a spherical shape 73 and rotatably received 17 in the cross member 7 thereby allowing the cylindrical member 71 to be tilted to any desired angle.

The stand portion 74 is disposed a little above the lower end of the leg portion 72, and the cylindrical member 71 can be fixed at any desired angle by fastening the bolt 18 and the nut 19.

In this manner, the front doors 21A, 21B are fixed by means of the supporting member 7, and at the same time the cylindrical member 71 of the burner supporting member 70 can be disposed such that the opening thereof is directed to the center of the opening 3*a* of the combustion drum 3.

75 denotes a stopper fixed to the stand portion 74 as one body, which binds rotation of the stand portion 74 by mating with the cross member 7.

The chute door 22 is opened in such a manner that it is declined downward to become an extension of a discharging passage of the opening 3*a* of the combustion drum 3 when the opening 3*a* is tilted downward for discharging a regenerated asphalt. In other words, the shoot door 22 can be utilized as a discharging shoot.

At one corner of the front portion of the casing 2 is formed a housing portion 22, and a gas cylinder 80 is housed therein.

The burner 8 is a portable burner which is connected to a gas cylinder 80 from which fuel is supplied thereto.

This burner 8 is held on a holder (not shown) provided on the side of the casing 2 when it is not in use.

The upper and lower portions of the front portion of the casing 2 are provided with a plurality of shelves 23 for housing fire extinguishers in order to cope with any fire accident 81 that might be happened.

A switch box 24 is provided above the shelves 23 to accommodate various kinds of operating switches.

Next, the operation of the asphalt recycling apparatus having above-mentioned structure will be explained.

First, the front door 21A, 21B of the casing are opened and finely crushed asphalt pieces are thrown into the combustion drum 3 through the opening 3*a*. Then, the cross member 7 and the burner-supporting member 70 are fixed between the front door 21A and the front door 21B. Thereafter, the burner 8 is inserted into the cylindrical member 71 and fixed thereto so as to direct the distal end portion of the burner 8 to the center of the opening 3*a* of the combustion drum 3.

Fuel is supplied from the gas cylinder 80 to the burner 8 from which fire flame is ejected into the interior of the combustion drum 3, and at the same time the combustion drum 3 is rotated around the axis (65) therof by means of the electric motor 4, the driving power of which is transmitted through the transmission gear 68 and the engagement between the combination of the main driving gear 63 and the driven gear 64 and the crown wheel (gear) 30 to the combustion drum 3, thereby uniformly heating and melting the crushed asphalt pieces.

When the asphalt pieces are completely molten, the supply of fuel from the gas cylinder 80 is stopped, and the firing from the burner 8 is terminated.

Then, the handle 5 is rotated thereby to cause the shaft 62 and the connecting rod 67 to rotate via the handle shaft 50, and as a result to cause the combustion drum 3 to rotate to such degree that the opening 3*a* thereof faces downward as indicated by a phantom line in FIG. 1.

The molten regenerated asphalt is smoothly discharged from the opening 3*a* to a road requiring site through the chute door 22 extending from the opening 3*a*.

Since the asphalt recycling apparatus as explained above can be small in size, it can be installed on a portion of the loading platform 10A of a truck 10, thus leaving sufficient space on the loading platform 10A for installing other operation apparatus for repairing underground piping and wiring, or a shelf for equipments, or a temporary toilet. It is possible according to this invention to employ as the burner 8 a small-sized burner which is conventionally employed in heating a paved road surface.

Since the combustion drum is provided with the heat-insulating cover, the thermal insulation property of the combustion drum is excellent, thereby enhancing the asphalt-dissolving efficiency.

Further, the presence of the heat-insulating cover is effective in preventing the casing from being heated to a high temperature through a radiant heat, and therefore the safety of operation is assured.

Since waste asphalt pieces obtained from the repairing work site can be reused as they are for restoring the road, labor and time for restoring the road can be markedly saved.

According to the asphalt recycling apparatus of this invention as explained above, the cross member means 7 is connected by one end thereof to the front door of the casing 2, the burner supporting member 70 can be easily set for else.

The shape and structure of the combustion drum may be modified in any manner as far as the combustion drum is designed to rotate around the axis therof, and the upper opening therof can be tilted downward as required.

What is claimed is:

1. An asphalt recycling apparatus comprising a combustion drum having an open top, a frame rotatably supporting said combustion drum, said frame being mounted in a casing;

said combustion drum having a longitudinal axis extending through said open top;

said combustion drum having an outer surface covered by a heat insulating cover, said heat insulating cover having an inner surface spaced uniformly from the outer surface of said combustion drum, an insulating material being disposed between said heat insulating cover and said outer surface of said combustion drum;

driving means for rotating said combustion drum about said longitudinal axis thereof;

said combustion drum being tiltably mounted on said frame and said apparatus including a tilting handle for tilting said combustion drum relative to said frame;

said casing having an open portion having opposite sides and a pair of front doors each hingedly mounted on a said side of said open portion for closing said open portion;

said doors including a cross member extending from one of said doors and being detachably connected to said doors;

said cross member including a burner-supporting member positioned so as to direct the flame of a burner toward said open top of said combustion drum when in use; and said casing including a chute door disposed below said open portion;

said chute door being pivotally attached to said enclosure so as to pivot about a generally horizontal axis between an up position and a down position.

2. An asphalt recycling apparatus as claimed in claim 1 wherein a burner is provided and said casing having a housing for a gas cylinder to which said burner is connected.

3. An asphalt recycling apparatus according to claim 1, wherein said casing (2) is provided with a shelf on which a fire extinguisher is to be loaded.

4. An asphalt recycling apparatus according to claim 1, wherein said one end of the cross member (7) is rotatably fixed to a first bracket (12A) projecting from the back surface of said one of the front door, and said the other end of the cross member (7) is provided with a through hole which is adapted to detachably engage with a pin mounted on a second bracket (12B) projected from the back surface of said the other one of the front door.

5. An asphalt recycling apparatus according to claim 1, wherein said burner (8) is supported on said burner-supporting member (70) comprising a cylindrical portion (71) for fitting said burner therein, a leg portion (70B) for sustaining the cylindrical portion (71), and a stand portion (74) supporting the leg portion, said stand portion (74) being fixed through a screw to the cross member (7).

* * * * *